United States Patent [19]

Sawazaki

[11] 3,940,950

[45] Mar. 2, 1976

[54] LEVER NEEDLE SELECTING MEANS FOR CIRCULAR KNITTING MACHINES

[75] Inventor: Masatoshi Sawazaki, Kobe, Japan

[73] Assignee: Precision Fukuhara Works, Ltd., Kobe, Japan

[22] Filed: July 5, 1974

[21] Appl. No.: 485,885

[30] Foreign Application Priority Data

Sept. 21, 1973 Japan ..... 48-106660

[52] U.S. Cl. ..... 66/50 R; 66/42

[51] Int. Cl.² ..... D04B 9/00

[58] Field of Search ..... 66/50 R, 8, 30, 46, 25, 66/42, 50 A, 50 B, 75, 115

[56] References Cited

UNITED STATES PATENTS

| | | | |
|---|---|---|---|
| 408,952. | 8/1889 | Butz | 66/46 |
| 472,029 | 4/1892 | Cathcart et al. | 66/46 |
| 1,687,132 | 10/1928 | Lombardi | 66/50 R X |
| 2,984,999 | 5/1961 | Paul | 66/8 X |
| 3,283,540 | 11/1966 | Levin | 66/36 A |
| 3,552,148 | 1/1971 | Wiesinger | 66/50 R X |
| 3,793,850 | 2/1974 | Wills-Moren et al. | 66/50 R |
| 3,877,255 | 4/1975 | Allavena | 66/50 R X |

FOREIGN PATENTS OR APPLICATIONS

| | | | |
|---|---|---|---|
| 509,982 | 7/1939 | United Kingdom | 66/50 R |
| 1,140,839 | 1/1969 | United Kingdom | 66/8 |

OTHER PUBLICATIONS

Knitting Times, Feb. 12, 1973, Vol. 42, No. 7, pp. 94 & 95.

*Primary Examiner*—Mervin Stein
*Assistant Examiner*—Andrew M. Falik
*Attorney, Agent, or Firm*—Nathan Levin

[57] ABSTRACT

Multi-feed circular knitting machine having three level selecting means for lever operated needles. The needles have radially extending pivotally movable levers individually associated therewith in such manner that rocking movements of said levers act to raise and to lower the needles, and there are movable control members individually associated with the levers to rock the same in one direction to raise the needles from welt to tuck and to knit levels. There is a needle raise cam engageable with the control members to lower the same thereby to rock the levers to raise the needles and there is a needle lowering cam engageable with the levers thereby to rock the same in the opposite direction to lower the needles. The levers act to multiply the movement imparted to them by the needle raise and lowering cams thereby to move the needles along pathways which are steeper than the cam faces. Selectively operated pattern jacks individually associated with the control means are provided to disengage selected ones of the control members from the needle raise cam at two places along the face thereof in order to position selected ones of the needles at welt, tuck and at knit levels.

4 Claims, 12 Drawing Figures

LEVER NEEDLE SELECTING MEANS FOR CIRCULAR KNITTING MACHINES

Figure 2:
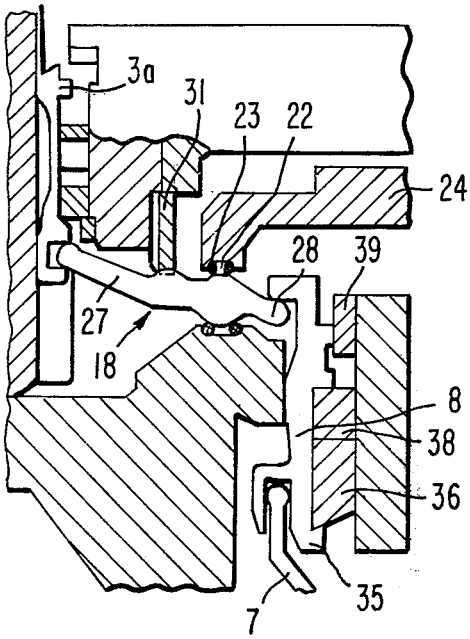

The present invention relates generally to the art of knitting and more particularly to improved lever operating means for use upon multi-feed circular knitting machines for the raising and lowering of the needles thereof along sharply angled pathways, and to means for three position selection of the needles at knit, tuck and welt levels in combination with the lever operating means for the needles.

In multi-feed circular knitting machines it is desirable to have the maximum number of feeds thereon so that the machine, operating at a maximum permissable speed, can produce the maximum amount of knit fabric, and, in addition, it is also desirable to have means upon the machine for three position selection of the needles at knit, welt and tuck levels in order to produce pattern effects in the fabric during the making thereof. Since the extent of lengthwise travel from welt to knit level is constant for needles having a given length of latch, it has been customary, in machines wherein the needles are raised and lowered by means of raising and lowering cams which act directly upon the needle butts, to increase the number of feeds per machine by increasing the angle of the cam faces of the raising and lowering cams thereby to provide a more sharply angled pathway for the needles. Further, in those machines which also have means for three position selection of the needles, it has been customary to use a minimum of circumferential distance for such selecting means in order to have the maximum number of feeds. However, with use of the more sharply angled needle operating cams to provide more feeds, the speed of the machine is reduced to avoid butt breakage by the cam action so that the increase in fabric production is not proportional to the increase in the number of feeds.

Accordingly, it is the principal object of the present invention to provide improved means for raising and lowering the needles of multi-feed circular knitting machines along sharply angled pathways by means of levers interposed between the needles and shallow angled raising and lowering cams for the levers whereby a maximum number of feeds may be placed upon the macchine and whereby the shallow angled cams permit the machines to be operated at their most effective rate of speed.

It is a further object of the present invention to provide for selective multi-level positioning of the needles in combination with the lever operation thereof.

It is a still further object of the present invention to provide for selective disengagement of the needle operating levers from the needle raise cam in such manner as to provide for three position selection of the needles at knit, tuck and at welt levels.

With the above and other objects in view which will become apparent from the following detailed description of a preferred embodiment of the invention shown in the accompanying drawings, the present invention resides in the novel elements of construction and arrangement of parts of the lever needle selecting means for circular knitting machines illustrated and as hereinafter particularly pointed out in the appended claims.

Figure 1:
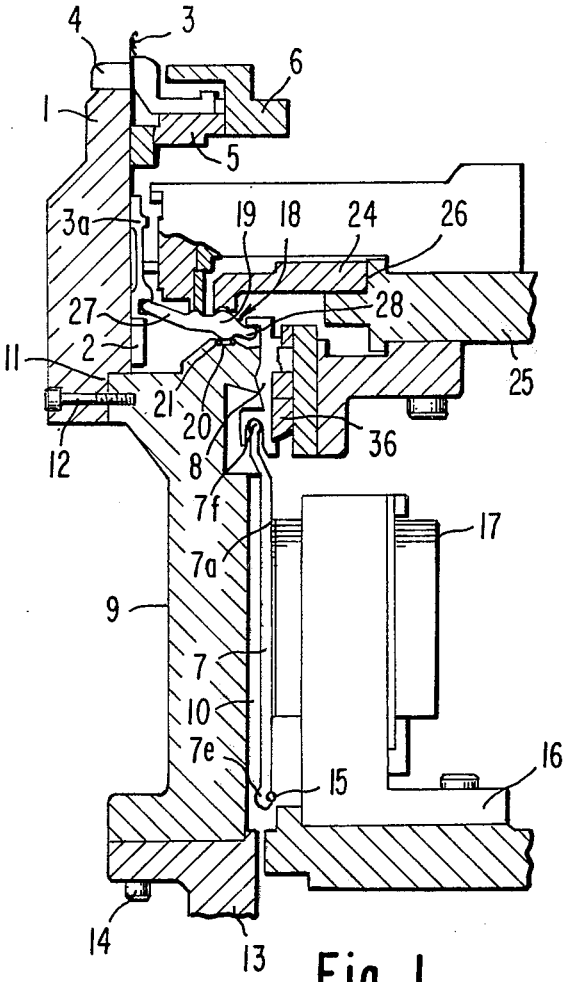
Figure 3:
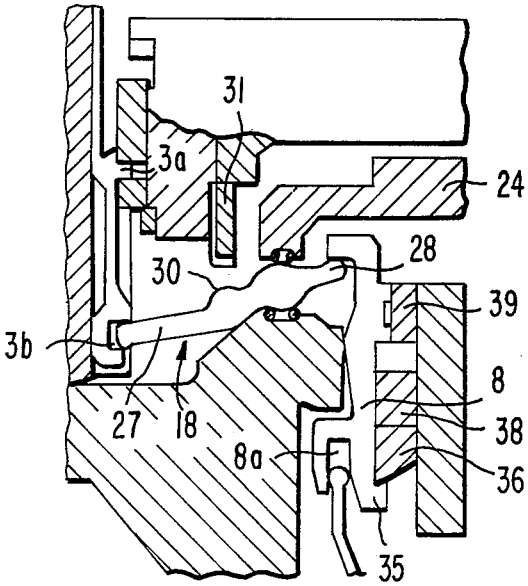
Figure 4:
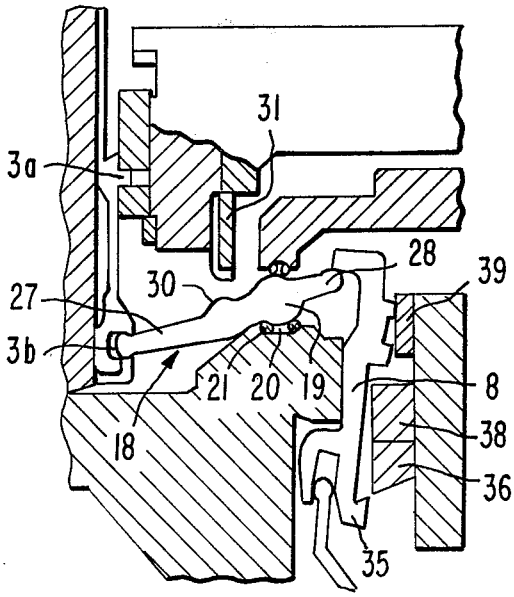
Figure 6:
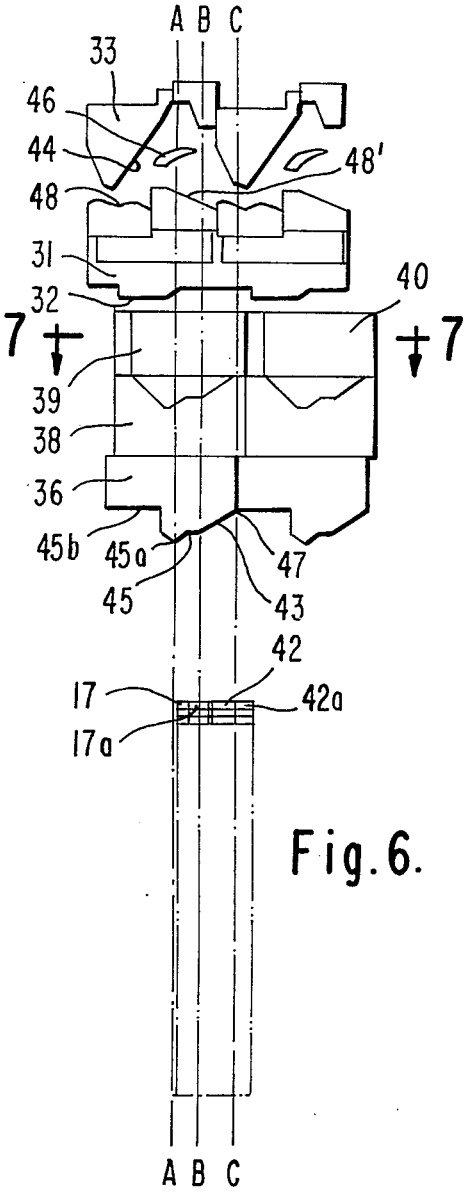
Figure 5:
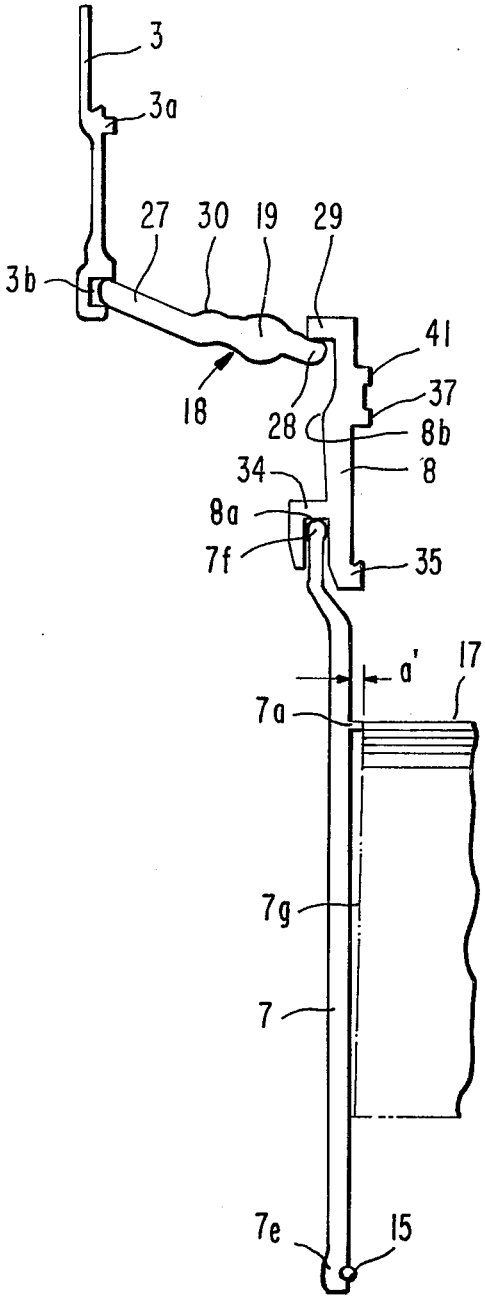
Figure 7:
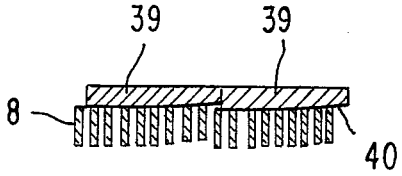
Figure 11:
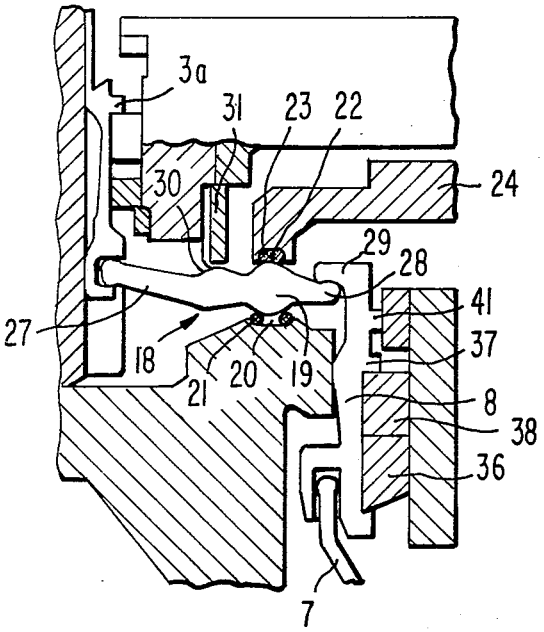
Figure 12:
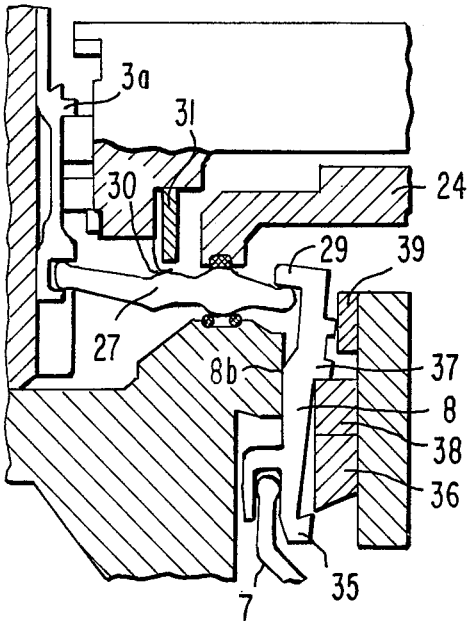
Figure 8:
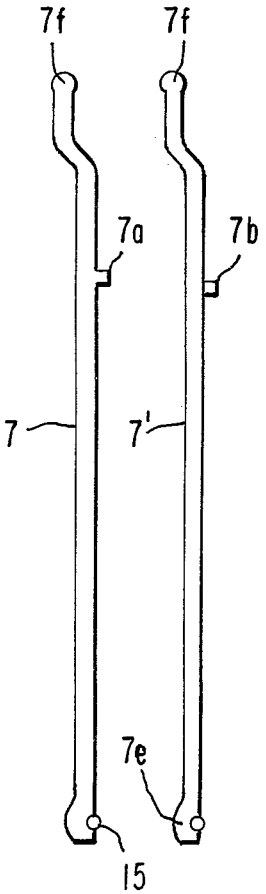
Figure 9:
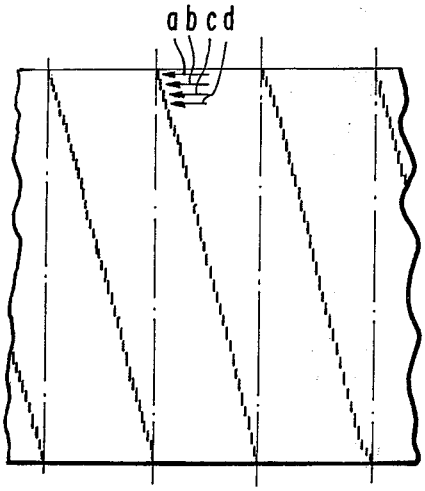
Figure 10:
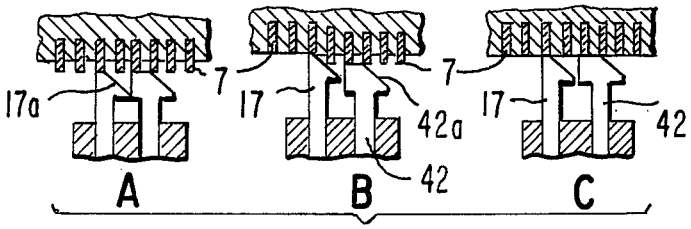

In the drawings:

FIG. 1 is a vertical sectional view through the needle cylinder and surrounding cam ring of a multi-feed circular knitting machine embodying the lever needle selecting means of the present invention, and showing the larger diameter cylinder for the presser pattern jacks, the sub-jacks controlled by the presser jacks, the multiplying levers connecting the sub-jacks to the needles, the cam acting upon the sub-jacks to raise the needles, and the cam acting upon the levers to lower the needles, FIG. 2 is an enlarged schematic view of a portion of FIG. 1 showing the needle and associated parts in knit position with the sub-jack at its lowermost position on the needle raise cam, FIG. 3 is a view similar to FIG. 2 with the needle and associated parts in welt position with the sub-jack at its uppermost position on the needle raise cam, FIG. 4 is a view similar to FIG. 3 showing the sub-jack removed from the needle raise cam, FIG. 5 is a schematic view in elevation of a vertically extending needle, a vertically extending pivotable pattern presser jack, a vertically extending pivotable sub-jack slidably connected to the upper end of the presser jack, a horizontally extending multiplying lever connected to the lower end of the needle and to the upper end of the sub-jack, and presser cams for selectively moving the presser jacks, FIG. 6 is a schematic face view of the cams at each feed of the machine for operating upon the needles, presser jacks, sub-jacks and multiplying levers, FIG. 7 is a cross-sectional view of the return cam adapted to act upon the sub-jacks, as taken on line 7—7 of FIG. 6, FIG. 8 is a view in elevation of a pair of pattern presser jacks, FIG. 9 is a schematic view in elevation of some of the recurring series of diagonally extending butts of the pattern presser jacks in the machine, FIG. 10 is a schematic view showing the operation of two sets of presser cams upon the presser jacks to selectively place the needles in their knit, tuck and welt positions, FIG. 11 is a view similar to FIGS. 2 and 3 with the needle and associated parts in tuck position and with the corresponding sub-jack in an intermediate position on the needle raise cam, and FIG. 12 is a view similar to FIG. 11 showing the sub-jack removed from the needle raise cam.

The needle cylinder of the circular knitting machine embodying the present invention is shown at 1 in FIG. 1 with vertically movable needles 3 in slots 2 of the cylinder. The needles are provided with conventional working butts 3a and have extended shanks the end portions of which are provided with radially extending U-shaped apertures 3b to receive therein one end of the needle moving multiplying levers to be described. Sinkers 4, between the needles, move radially in slots in sinker bed 5 secured to the upper end of the needle cylinder, the sinkers being actuated by cams in sinker cap 6.

A jack cylinder 9 of larger diameter than the needle cylinder is disposed co-axially therewith, the upper end of the jack cylinder being disposed in peripheral groove 11 formed at the bottom of the needle cylinder and being secured to the latter by suitably disposed bolts 12. A conventional ring gear 13, secured to the bottom of the jack cylinder by suitably disposed bolts 14, is driven in customary manner to rotate the joined jack and needle cylinders.

The periphery of jack cylinder 9 is provided with vertically extending slots 10 equal in number to and aligned with needle slots 2 of the needle cylinder. Disposed in each slot 10 is a pattern pressure jack 7, FIGS. 1, 5, 8, pivotally movable at its enlarged lower end 7*e* about a peripherally extending garter spring 15 encircling the jack cylinder in a circumferential groove formed therein while the spring, at the same time, is disposed in suitable semicircular depressions formed in the jack ends 7*e*, the presser jacks thus being secured against vertical movement while being pivotable about the garter spring as a fulcrum. The upper ends 7*f* of the presser jacks are ball shaped to slidingly engage within inverted U-shaped slots 8*a* in arm 34 of the sub-jacks 8, the latter being individually related to the presser jacks in such manner that the jacks and sub-jacks may move pivotally and longitudinally with respect to each other.

Each of the presser jacks is provided with a single radially extending pattern butt thereon by means of which the jacks are selectively and pivotally pressed inwardly of the slots in the jack cylinder. The pattern butts, FIG. 9, are disposed at each of thirty seven separate levels upon each of 37 correspondingly adjacent individual presser jacks. Jack 7 has its butt 7*a* at the uppermost of the butt levels, FIG. 8, jack 7′ has its butt 7*b* at the next uppermost level, and so on, as indicated by the letters *a*, *b*, *c* and *d*, FIG. 9, representing the butts at the four highest of the thirty seven levels upon four adjacent ones of the presser jacks. It will be noted that the butts upon each of successive groups of the 37 presser jacks extends diagonally, one after the other, about the jack cylinder. The radial measurement of the butts gradually decreases from the uppermost to the lowermost one thereof, thus, while the length of uppermost butt 7*a* on jack 7 is shown at *a′*, FIG. 5, the length of butt 7*b* on jack 7′ is somewhat less, and so on for butts *c* and *d* and the remainder of the butts, as indicated by the line 7*g*, FIG. 5.

The jacks 7 are selectively moved inwardly, via their butts, by selected ones of each of two adjacently stacked series of 37 presser cams 17 and 42, FIGS. 5, 10. The cams 17 comprise one series of cams while the cams 42 comprise the second series of cams, the cams 17 have sloped faces 17*a* while the cams 42 have sloped faces 42*a* to engage the jack butts to press the jacks inwardly. The cams 17 and 42 are vertically stacked and contained in the presser cam holder 16, FIG. 1, and any suitable pattern means may be employed to selectively place each of the cams 17 and/or 42 in forward jack butt operating position in accordance with a predetermined pattern selection. As in FIG. 10, cams 42 are disposed ahead of cams 17 so as to act first upon the jacks, in position A cams 17 and 42 are not pushed in and accordingly jacks 7 are likewise not pushed in thereby resulting in the needles corresponding to such jacks being raised to knit level, by means to be described. As in position B of FIG. 10, cams 42 are not pushed in while cams 17 are pushed in to push jacks 7 inwardly and this arrangement results in the corresponding needles being raised to tuck level. In position C, cams 17 and 42 are both pushed in to push jacks 7 inwardly and this arrangement results in the corresponding needles remaining at welt level. Cams 17 and 42 thus differ only in the time of their action upon the jacks, and, in fact, in position C the same results may be obtained by pushing only cams 42 inwardly. The outward position of jacks 7 may be seen in FIGS. 1, 3, 5 while their inward position may be seen in FIGS. 4,6.

The sub-jacks 8, also disposed in suitable slots provided in cylinder 9, are both vertically and pivotally movable, the inward pivotal movement of their lower ends taking place when their corresponding jacks 7 are moved inwardly by cams 17, 42. The sub-jacks 8 are each provided, on their inner edge, with intermediate fulcrum rocking point 8*b*, at their upper end with radially inwardly extending butt 29, at their lower end with radially outwardly extending butt 35, and, intermediate fulcrum 8*b* and butt 29, with spaced radially outwardly extending butts 37,41, the butts 37,35 providing a cut out portion therebetween for cams 36, 38 to be positioned therein.

Joining sub-jacks 8 to needles 3 are multiplying levers 18, also disposed in suitable slots provided at the upper end of jack cylinder 9, these levers being rockable about a circular fulcrum 19 and having a shorter arm 28 the ball shaped end of which is disposed under butt 29 of sub-jack 8, and also having a longer arm 27 the ball shaped end of which is rockably disposed in slot 3*b* of the needle. Levers 18 have semi-circular portions 30 on the upper sides of their longer arms at an intermediate point along the same. The lower edge sections of fulcrum 19 of levers 18 are rockably supported upon a spaced pair of steel wires 21 disposed in and extending alonga peripherally formed groove 20 in the upper end of cylinder 9. The upper edge sections of fulcrum 19 are covered by a pair of similar steel wires 23 disposed in and extending along a peripherally formed groove 22 in a depending portion of ring 24, the latter ring being suitably secured in a circular groove 26 formed in the upper bed plate 25 of the machine.

Lever 18 is rocked in clockwise direction about pivot 19, FIG. 5, to raise needle 3 from welt to tuck and to knit levels via arm 27 in slot 3*b* of the needle, by the downward movement of sub-jack 8 via its butt 29 pulling downward upon arm 28 of the lever. The sub-jacks 8 are moved downwardly, when jacks 7 are in their outward non-selected position, by means of relatively shallow angled cams 36, 38 which are positioned between butts 35, 37 of the sub-jacks. While cams 36, 38 may be considered as lowering cams with respect to the sub-jacks and levers, they are also to be considered as raise cams with respect to the needles. It will be noted that cams 36, 38 do not lower the sub-jacks when the latter have been rocked inwardly, FIGS. 4, 12, by the inward movement of selected jacks 7 which serves at the same time to pull the sub-jacks off the cams. The head 7*f* of the jacks in slots 8*a* of the sub-jacks acts to pull the sub-jacks off the cams, the sub-jacks being rocked about their fulcrum points 8*b*.

The jacks can pull the sub-jacks off the cams before any downward movement thereof takes place, the sub-jacks then being at point or level 47 along lone C—C of FIG. 6 which corresponds to the welt level of the needles, the position of the sub-jacks on the cams being shown in FIG. 3 while the position of the sub-jacks after having been pulled from the cams being shown in FIG. 4. The position of cams 17, 42 at this time to pull the jacks off the cams when the needles are at welt level is shown at C in FIG. 10 where cams 17, 42 are in their inward selecting positions.

The jacks can also pull the sub-jacks off the cams after the latter have been partially lowered by cam face 43 of cams 36, 38 to level 45 along line B—B of FIG. 6 which corresponds to the tuck level of the needles, the position of the sub-jacks on the cams being shown in FIG. 11 while the position of the sub-jacks after having been pulled from the cams being shown in FIG. 12. The position of cams 17, 42 at this time to pull the jacks off the cams when the needles are at tuck level is shown at B in FIG. 10 where cams 42 are in outward non-selecting position and cams 17 are in inward selecting position.

Further, when it is desired that the needles are to be raised to knit level, the jacks are not selected at all so that the sub-jacks are not pulled from their lowering cams, as may be seen in FIGS. 1, 2 wherein the needles are at knit level with the sub-jacks at their lowermost position upon their lowering cams. This corresponds to level 45*a* along line A—A, FIG. 6, with cams 17, 42 intheir outward non-selecting position A of FIG. 10. The needle butts 3*a* of needles raised to knit and to tuck levels pass above cam 46, while the needle butts remaining at welt level pass below this cam.

The needles are lowered toward welt level, FIG. 3, from their knit and tuck levels, by the action of relatively shallow angled cam face 32 of cam 31, at line A—A FIG. 6, upon the rounded projection 30 of lever 18 which is thereby rocked in counterclockwise direction. Cam 31 acts as a lowering cam for end 27 of the levers and may also be considered as a needle lowering cam. As the needles are thus being lowered, the shorter ends 28 of the levers act to raise the sub-jacks toward their uppermost position, the latter being free of their lowering cams at 45*b* thereof at this time. While the sub-jacks are thus being raised, they are also subjected to the rocking action of inclined face 40 of return cam 39 acting upon their butts 37,41 so that those of the sub-jacks which have been selectively pulled off their lowering cam are rocked about fulcrum 8*b* to their outward position, FIG. 3, ready for a selection at the next feed of the machine. As the sub-jacks are rocked by return cama 39, their associated jacks 7 are at the same time thereby moved outwardly of the jack cylinder in position for a fresh selection thereof by cams 17, 42 at the next feed of the machine. After the needles are lowered by return cam 31, their butts 3*a* are also acted upon by face 44 of stitch cam 33, and after being fully lowered thereby to welt level, the needle butts are acted upon by cushion cam 48 and then by the guard cam 48'. Such lowering of the needles to welt level causes the sub-jacks to be fully raised.

It will be noted that, by the apparatus provided, the needles are caused to be raised at a very steep angle by the shallow angled cam 36 acting via sub-jacks 8 upon the shorter arms of levers 18 to the longer arms of which the needles are connected, and that the needles are caused to be lowered at a very steep angle by the shallow angled cam 31 acting at a point along the longer arms of the levers 18 which, at the same time, cause the sub-jacks to be raised. Thus the needles are raised and lowered at steeper angles than would be possible by the use of needle raising and lowering cams acting directly upon the needle butts, and, thereby less circumferential extent is required for each feed of the machine. In addition, the present apparatus provides for selective disengagement of the sub-jacks 8 with cam 36 whereby the needles may be selectively positioned at knit, tuck and welt levels. The present needle selecting means takes up no additional circumferential space between the feeds of the machine and the shallow angled needle operating cams 31, 36 and 38 permit the machine to be operated at higher speeds than they could be operated when sharply angled needle raise and lowering cams acted directly upon the needle butts. Inasmuch as the sub-jacks 8, depending upon their position, act to control whether or not needle raise cam acts upon levers 18, the sub-jacks have been referred to as control members in the claims.

I claim:

1. A mult-feed circular knitting machine having a vertically extending slotted needle cylinder and a circle of needles individually disposed in said needle slots for independent reciprocating movement therein, said reciprocating movement of said needles being between the welt, tuck and knit levels of their knitting stroke, a circle of like pivotally movable levers extending radially outwardly of said circle of needles, each of said levers having a longer and a shorter arm of which the former are individually and operatively related to said needles to move the same, said levers being rockable in one direction to raise said needles and being rockable in the opposite direction to lower said needles thereby to move said needles through their knitting stroke, a circle of like vertically extending and reciprocatingly movable control members individually and operatively related to said shorter arms of said circle of levers to rock the same in said one direction when said control members are moved downwardly, said control members being movable upwardly by said levers when the latter are rocked in said opposite direction, a fixed needle raise cam at each feed of the machine rotatable relative to and in engagement with said circle of control members to move the same downwardly from a first to a second and to a third level thereby to rock said levers accordingly in said one direction and thereby to raise said needles via said levers from welt level to tuck and to knit levels, respectively, a fixed needle lowering cam at each feed of the machine rotatable relative to and in engagement with said longer arms of said circle of levers to rock the same in said opposite direction thereby to lower said needles and at the same time to cause said levers to raise said control members, and pattern controlled means capable of acting upon said circle of control members to disengage selected ones of the latter from contact with said needle raise cam at an earlier and at a later time, certain of said control members being so disengaged from said needle raise cam at an earlier time when they are at their first said level whereby the needles associated with said cetain control members are not raised and remain at their welt level, certain other of said control members being so disengaged from said needle raise cam at a later time when they are at their said second level whereby the needles associated with said certain other control members are raised to and remain at their tuck level, the arms of said levers being so proportioned that said needles are raised and are lowered in their knitting stroke along pathways the angles of which are steeper than the angles of the cam faces of said needle raise cam and of said needle lowering cam, respectively.

2. A machine as in claim 1 wherein said needles are provided with operating butts, and a stitch cam at each feed of said machine rotatable relative to said needles, said stitch cam being engageable with said needle butts to lower said needles after said needles have been lowered via said levers by the action of said fixed needle lowering cam.

3. A machine as in claim 1 wherein said pattern controlled means includes a circle of pattern jacks individually related to said circle of control members, and wherein said jacks are selectively operated to cause disengagement of correspondingly selected ones of said control members from said needle raise cam.

4. A machine as in claim 3 wherein said pattern controlled means includes a first and a second set of cams both sets of which are selectively operable upon said pattern jacks, said first set of cams being operable upon said pattern jacks prior to the operation of said second set of cams thereon, selected ones of said first set of cams causing selected ones of said pattern jacks to disengage correspondingly associated control members from said needle raise cam to position correspondingly associated needles at welt level, and selected ones of said second set of cams causing selected ones of said pattern jacks to disengage correspondingly associated control members from said needle raise cam to position correspondingly associated needles at tuck level.

* * * * *